United States Patent [19]

Tesch

[11] 4,168,880

[45] Sep. 25, 1979

[54] ELECTRICAL SOCKET

[75] Inventor: Hans-Jurgen Tesch, Oberageri, Switzerland

[73] Assignee: CDS Connectors Development and Supply AG, Zug, Switzerland

[21] Appl. No.: 897,545

[22] Filed: Apr. 18, 1978

[30] Foreign Application Priority Data

May 25, 1977 [CH] Switzerland ..... 6420/77

[51] Int. Cl.[2] ..... H01R 13/16

[52] U.S. Cl. ..... 339/259 R

[58] Field of Search ..... 339/256 R, 259 R, 262 R, 339/262 P

[56] References Cited

U.S. PATENT DOCUMENTS

| | | | |
|---|---|---|---|
| 3,112,977 | 12/1963 | Long et al. | 339/262 R |
| 3,781,770 | 12/1973 | Mancini | 339/259 R |

FOREIGN PATENT DOCUMENTS

| | | | |
|---|---|---|---|
| 719293 | 11/1931 | France | 339/259 R |
| 674399 | 11/1964 | Italy | 339/262 R |
| 940437 | 10/1963 | United Kingdom | 339/259 R |

*Primary Examiner*—Joseph H. McGlynn
*Attorney, Agent, or Firm*—Watson, Cole, Grindle & Watson

[57] ABSTRACT

An electrical socket comprising an elongated, hollow socket body constructed of electrically conductive material and defining a plug receiving bore opening at one end thereof. The socket body includes means presenting a series of slits in the body that together define a longitudinally extending contact finger which has a free end disposed in proximal relationship to one end of the plug receiving bore. An elongated, annular spring cage is disposed in surrounding relationship to at least the portion of the socket body which includes the contact finger and includes means for biasing the contact finger toward and into the plug receiving bore. The biasing means includes means defining a series of intercommunicated slits in the spring cage that together present a collar surrounding the end of the socket body in proximate relationship with the contact finger and a longitudinally extending tongue having a free end disposed adjacent the collar and in contacting relationship to the free end of the contact finger.

7 Claims, 7 Drawing Figures

ELECTRICAL SOCKET

BACKGROUND OF THE INVENTION

This invention is related to an electrical socket with a socket body made of electrical contact material, which has slits therein forming at least one radially flexible contact finger, and a spring cage made of spring sheet metal enclosing the outside of the socket body, which biases the contact finger inwardly.

Conventional prior art electrical sockets have the frequently encountered disadvantage that the pressure exerted on the plug by the spring cage acting upon the contact finger, deviates over a wide pressure range from one plug-and-socket connection to another. This variation is attributable to the differences in the shaping of the parts while they are being manufactured. Therefore, the purpose of the present invention is to design a socket in which there is less variation in the spring tension operating on the inserted plug as communicated by the contact finger.

The solution to the problem lies in recognizing that the less the transconductance of the elasticity characteristic in the power/channel diagram, the less the spring tension operating on the contact plug will be dependent on the manufacturing tolerances of the parts. This is achieved, in the present invention, by forming a collar on the spring cage which surrounds the socket body at one end and has at least one biasing tongue, with a free end extending along the length of the spring cage between the collar and the opposite end of the spring cage. This biasing tongue is formed by slits in the spring cage. The tongue exerts pressure radially, inwards, on the contact finger of the socket body.

SUMMARY OF THE INVENTION

Accordingly, it is the object of the present invention to provide an electrical socket intended to receive a plug establishing a releasable electrical connection between the socket and the plug. The socket body is made of electrical conductive material such as brass, copper or bronze, which ensures a low electrical contact resistance and a relatively high current load capability. Due to the relatively low elasticity of these materials, they can be connected to an electrical lead by pinching or crimping. The function of the spring cage is to press the socket body contact finger flexibly inward to produce a contact pressure between the socket body and the inserted plug. The relatively low flexibility of the contact finger, would not be possible without utilization of the spring cage as disclosed herein.

The electrical contact resistance between the socket body and the inserted plug and the socket body's current-flow resistance would be increased, while the plug-and-socket connection's current load capability would be decreased if the spring cage, or a portion thereof, was pressing directly on the plug rather than biasing the contact finger. These inherent disadvantages would be further evident if the socket body were made of a springy material dispensing with an additional spring cage and making it questionable as to whether an acceptable pinching or crimping connection with the electrical lead be established.

These features of the invention and further details and advantages of special versions of it are made clear in the claims, the description which follows and the accompanying diagrams, which illustrate the invention.

DETAILED DESCRIPTION OF THE PREFERRED EMBODIMENT

Figure 1:
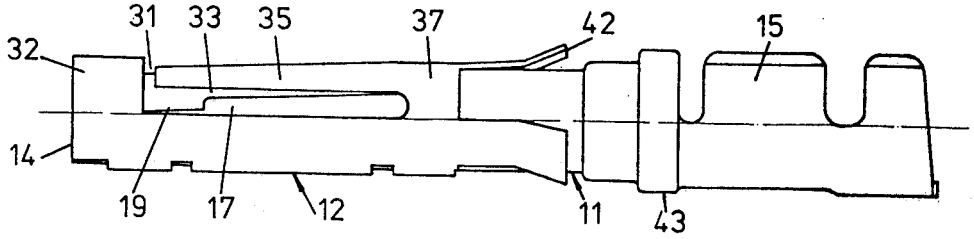
FIG. 1 is a side view of the electrical socket of this invention.
Figure 2:
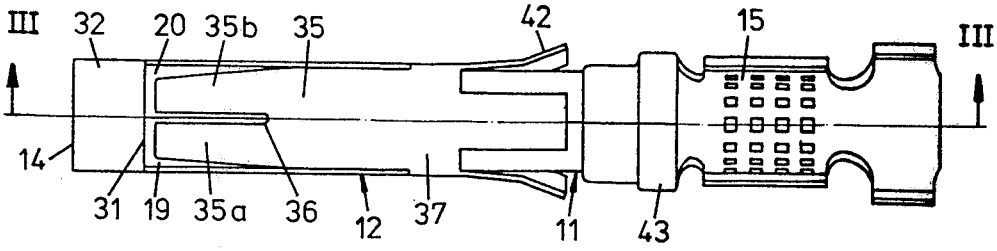
FIG. 2 is a plan view of the embodiment shown in FIG. 1.

The electrical socket represented in the drawing consists of an elongated hollow socket body 11 made of electrical contact material—brass, for example—and an elongated annular spring cage 12 made of spring sheet metal—sheet steel, for example—which surrounds the outside of the socket body. The socket body is rolled from sheet metal. A slit 13 is formed where the opposing cutting edges of the sheet metal butt flush against each other, as can be seen clearly in FIGS. 4, 5 and 6. One end of the socket body 11 has an aperture 14 for the insertion of an electrical plug (not shown). The opposing end portion of the socket body serves as a (U-shaped in cross section) connecting terminal 15 for securing an electrical lead (not shown). The lead can be connected mechanically and electrically by pinching the connecting terminal.

The socket body also has a transverse slit 16 (FIGS. 6 and 7) and two longitudinal slits 17 and 18 which are arranged symmetrically with respect to the slit 13 and in conjunction with slit 13 form two contact fingers 19 and 20 extending along the length of the socket body 11. The free ends of the two contact fingers 19 and 20, which terminate at the transverse slit 16, are turned toward the aperture 14. Between the aperture and the transverse slit 16, there is a ring-shaped end portion 21 of the socket body 11. The ring-shaped end portion 21 is radially inflexible relative to the two contact fingers 19 and 20 which are radially flexible along the longitudinal axis of the socket body 11. The end portions of the contact fingers 19 and 20 adjacent to the transverse slit 16 can be moved inward or outward. The two longitudinal slits 17 and 18 are arranged such that a socket part 22 is opposite the two contact fingers 19 and 20 and extends over approximately one half of the circumference of socket body 11, and is radially relatively inflexible. The edges of the socket part 22 adjoining the longitudinal slits 17 and 18 form a stop for the free end portion of each of the contact fingers 19 and 20 limiting the inward mobility of the contact fingers.

Figure 3:
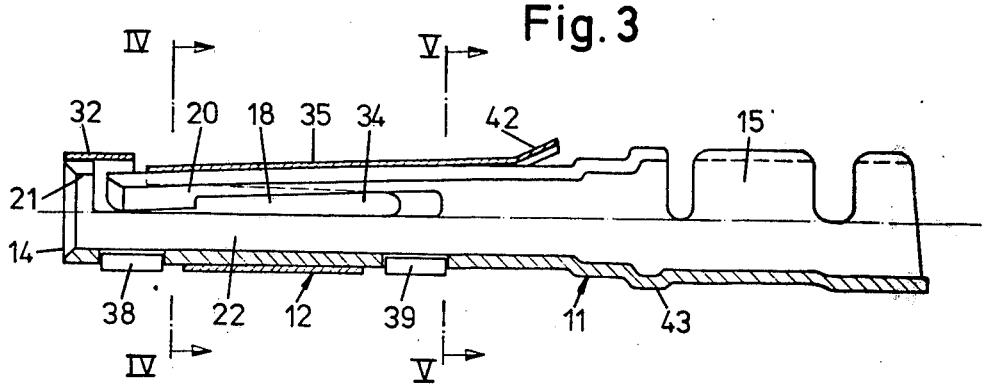
FIG. 3 is an axial longitudinal cross section of the socket along line III—III of FIG. 2.
Figure 4:
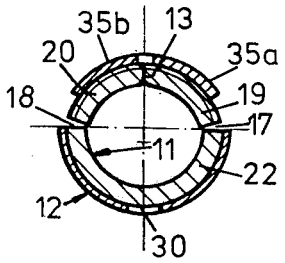
FIG. 4 is a cross section along line IV—IV of FIG. 3, in larger scale.
Figure 5:
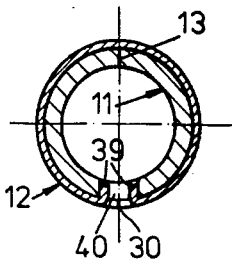
FIG. 5 is a cross section along line V—V in FIG. 3.
Figure 6:
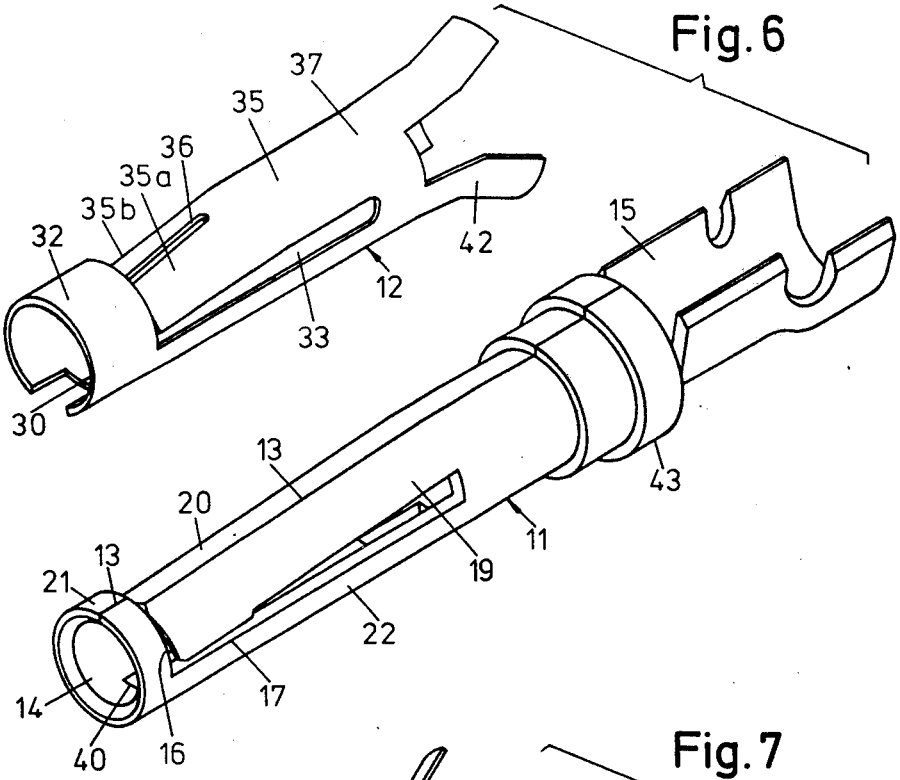
FIG. 6 is a perspective, separated view of the two structural elements of the socket—a socket body and a spring cage.
Figure 7:
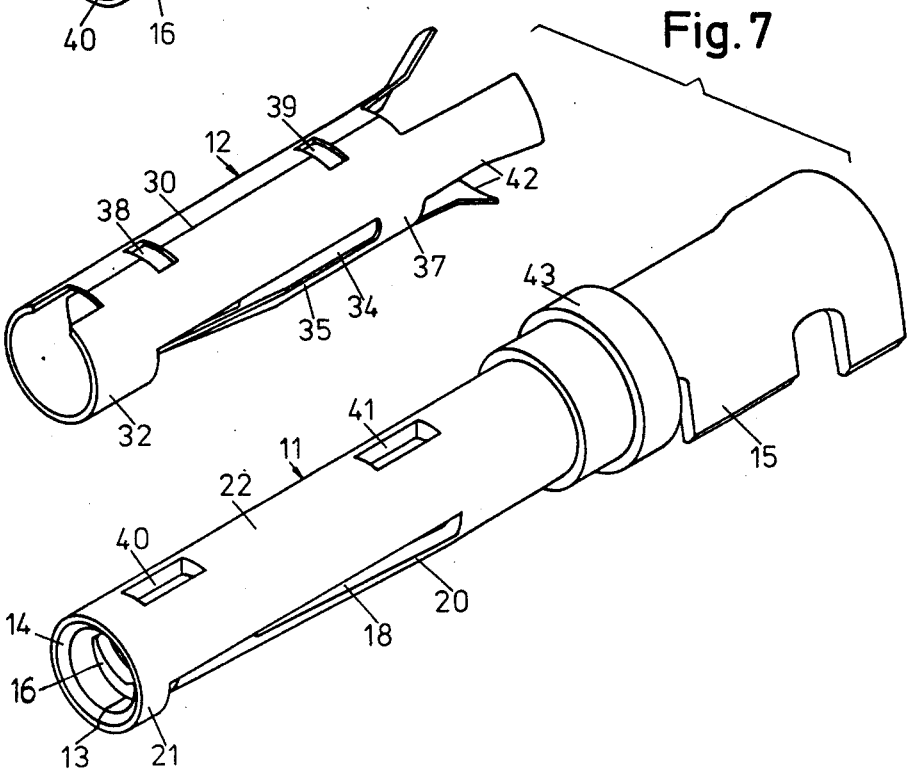
FIG. 7 is a perspective view of the same two structural elements shown in FIG. 6 rotated through 180°.

The spring cage 12 is essentially in the shape of a tube of spring sheet metal and has a slit 30 (FIGS. 6 and 7). The opposing cutting edges of the sheet metal butt flush against each other. When assembled together, the longitudinal slit 30 of the spring cage 12 is located diametrically opposite the longitudinal slit 13 of the socket body 11, as is shown in FIGS. 4 and 5. As assembled, one end of the spring cage 12 is flush with the aperture 14 of the socket body 11. The end portion of the spring cage 12 lying between the end flush with aperture 14 and transverse slit 13 forms a collar 32 which spans the inflexible, ring-shaped end portion 21 of the socket body 11. In the axial direction, the size of the collar 32 is somewhat larger than the corresponding size of the ring-shaped end portion 21 of the socket body, therefore, the collar 32 overlaps the transverse slit 16 of the socket body 11 and the free end portions of the contact fingers 19 and 20, as shown in FIG. 3. Consequently, a part of the collar 32 forms a stop to limit the outward mobility of the contact fingers 19 and 20.

Two longitudinal slits 33 and 34 originating at the ends of the transverse slit 31 of the spring cage 12 define together with the transverse slit 31 a tongue 35 whose free end is turned toward the collar 32 and bifurcated into two parts 35*a* and 35*b* by a longitudinal slit 36. The tongue 35 is located diametrically opposite the longitudinal slit 30 of the spring cage 12 and is formed such that in a released condition, i.e., when the spring cage 12 has not been placed around the socket body 11, the tongue is directed inward relative to the longitudinal axis of the spring cage. Therefore, in the assembled condition, the tongue 35, under the influence of its elasticity, exerts pressure on the contact fingers 19 and 20, with both of the two parts 35*a* and 35*b* pressing individually on one of the contact fingers in order to push it inward. The longitudinal slits 33 and 34, which run on both sides of the tongue 35, extend from the transverse slit 31 to the vicinity of the end 37 of the spring cage opposite the collar 32. The longitudinal slit 36 that bifurcates the tongue 35 is considerably shorter than the length of the longitudinal slits 33 and 34.

The spring cage 12 has two anchoring lugs 38 and 39 on the edges that form longitudinal slit 30. The lugs are located opposite each other in pairs and engage, in pairs, with an aperture 40 or 41 in the wall of the socket body 11 (FIGS. 3, 5 and 7). One pair of anchoring lugs 38 and the aperture 40 in which they engage are located in the vicinity of the collar 32 of the spring cage 12 and the ring-shaped end portion 21 of the socket body 11. The other pair of anchoring lugs 39 and the aperture 41 in which they engage are located in the vicinity of the opposite end 37 of the spring cage. The apertures 39 and 40 are located diametrically opposite the longitudinal slit 13 of the socket body. In order for the anchoring lugs 38 and 39 to get a firm hold in the apertures 40 and 41, the side of the apertures 40 and 41, which sealingly cooperate with the anchoring lugs, are arranged on levels that are parallel to each other. Therefore, the anchoring lugs 38 and 39, which are opposite each other, when in anchoring position are parallel to each other, as shown in FIG. 5. The collar 32 of the spring cage 12 is held firmly to the ring-shaped end portion 21 by means of the anchoring lug 38. The end portion 37 of the spring cage, which is opposite the collar 32, encloses the socket body 11 less firmly, preferably with some play. The purpose of this will later become apparent.

The end of the spring cage opposite the aperture 14 has several preventive lugs 42 that are supported by the socket body 11 and serve, along with an external bulge 43, to hold the socket 11 firmly in a housing made of insulating material (not shown), in a conventional manner.

The tongue 35 of the spring cage 12 presses the two contact fingers 19 and 20 of the socket body 11 inward so strongly that the free end portions of the contact fingers strike against the cutting edges of the inflexible socket part 22, as shown in FIGS. 3 and 4. If one inserts a plug, whose diameter is slightly smaller than the inside diameter of the ring-shaped end portion 21 of the socket body, into the aperture 14 of the socket body 11, the free end portions of the two contact fingers 19 and 20 are displaced from the cutting edges of the socket part 22. The displacement is counter to the influence of the flexibility of the tongue 35. The plug is clamped firmly by the flexible tongue 35 between the inflexible socket part 22 and the contact fingers 19 and 20 ensuring a small contact resistance between the plug and the socket body and additionally preventing the plug from slipping out of the socket. Deflection outward of the contact fingers 19 and 20 beyond what is permissible—for example, if the plug is inserted obliquely into the socket—is prevented by the collar 32 of the spring cage 12. The collar 32 overlaps the free ends of the contact fingers 19 and 20 and thus constitutes a stop to limit the outward mobility of the contact fingers. Thus, overloading of the flexible tongue 35 and consequent diminishment of the radial basing moment is prevented. Additionally, the collar 32 of the spring cage 12, which is positioned around the ring-shaped end portion 21, also protects the aperture 14 from enlarging, especially in the area of the slit 13 of the socket 11.

A particular advantage of the socket of the instant invention is that the tongue 35 of the spring cage 12 is relatively long, and therefore has a relatively flat characteristic in the channel-power diagram. The tongue 35, which is separated from the socket body 11, is bent relatively sharply inward. Therefore, when the socket is being assembled, the tongue 35 has a sharp initial spring pitch and a relatively high initial elastic stress, even when the two contact fingers 19 and 20 are pressed inward until they touch the cutting edges of the inflexible socket part 22. The spring pitch, which the free end of the tongue 35 gains when a plug is inserted into the socket, is small by comparison with the tongue's initial spring pitch, and therefore, the force with which the tongue presses on the contact fingers 19 and 20, increases only slightly. Thus, any variances in the manufacturer's tolerances in the dimensions of the interior diameters of the socket body 11 and the external diameters of the plug have only a slight effect upon the biasing pressure. Consequently, the manufacturer's tolerances have minimal influence on the quality of the electrical and mechanical connection between the socket and the plug, or upon the forces for overcoming friction between the plug and the socket body upon insertion or removal of the plug. The flat spring characteristic that is described also reduces the influence of all other manufacturer's tolerances on the quality of the socket and the plug-and-socket connections that can be obtained with it.

If the end portion 37 of the spring cage 12 opposite from the collar 32 encloses the socket body 11 with some play, the elasticity characteristic in the channel/-power diagram runs even flatter because not only the tongue 35 itself is springily flexible, but, in addition, the two sides of the spring cage between the slit 30 and the longitudinal slit 33 or 34 are also elastically flexible.

The socket, which has been described and is illustrated with diagrams, is relatively simple to produce and assemble, and the slight influence of manufacturer's tolerances on the quality of the socket and the plug-and-socket connections that can be established with it that was mentioned above has a favorable influence on the cost of producing it. Because of the characteristics described above, the socket is expecially suitable for multipolar plug-and-socket connectors. The interior diameter of the socket body 11 can be in the range of about 1.5 mm, for example.

While there has been shown and described what is considered to be a preferred embodiment of the present invention, it will be obvious to those skilled in the art that various changes and modifications may be made therein without departing from the invention as defined in the appended claims.

I claim:

1. An electrical socket which comprises an elongated, hollow socket body constructed of electrically conductive material, said socket body including an aperture at one end for receiving a plug and means forming a connecting terminal at the opposite end, said socket body including a transverse, circumferential slit near said aperture end of said body and at least two longitudinal slits communicating with said transverse, circumferential slit and extending towards said connecting terminal end of said body so as to form at least one contact finger means having a free end located near said aperture end of said body and a ring-shaped end portion at said aperture end, said contact finger means being radially flexible with respect to a center line passing through said elongated, hollow socket body, an elongated, annular spring cage positioned in surrounding relationship with at least that portion of said socket body which includes said contact finger means, said spring cage including a transverse, circumferential slit near one end thereof and at least two longitudinal slits communicating with said transverse, circumferential slit and extending towards the opposite end of said cage so as to form at least one tongue having a free end located near said one end of said cage and an end collar means at said one end, said end collar means surrounding said ring-shaped end portion of said socket body and said tongue being in contact with said contact finger of said socket body and shaped so as to resiliently bias said contact finger of said socket body radially inwardly towards a center line passing through said elongated, hollow socket body, said end collar means of said cage having a greater longitudinal dimension than said ring-shaped end portion of said socket body so as to partly surround the free end of said contact finger and thus limit outward radial movement thereof with respect to said center line.

2. The electrical socket of claim 1 wherein the inner diameter of said elongated, annular spring cage at said opposite end is larger than the outer diameter of the elongated, hollow socket body encompassed thereby such that some relative movement therebetween is permitted.

3. The electrical socket of claim 1 wherein the portion of said elongated, hollow socket body opposite said contact finger is inflexible such that the radial movement of said contact finger is limited.

4. The electrical socket of claim 3 wherein the transverse circumferential slits in both said elongated, hollow socket body and said elongated, annular spring cage extend about 180° around the circumferences thereof and wherein said two longitudinal slits in each of said elongated, hollow socket body and said elongated annular spring case are located diametrically opposite one another.

5. The electrical socket of claim 4 wherein a third longitudinal slit communicates with said transverse, circumferential slit in said socket body intermediate the two other longitudinal slits so as to form two parallel contact fingers, the inward radial movement of said contact fingers being respectively limited by the edge portions of said inflexible opposite portion of said socket body adjacent said respective longitudinal slits.

6. The electrical socket of claim 5 wherein a third longitudinal slit communicates with said transverse, circumferential slit in said elongated, annular spring cage intermediate the two other longitudinal slits so as to form a bifurcated portion of said tongue, said bifurcated portion contacting and exerting inward biasing pressure on said contact fingers of said socket body.

7. The electrical socket of claim 5 wherein said elongated socket body is fabricated from a tube rolled from a flat metal sheet, and wherein said third longitudinal slit therein is formed by the two abutting opposite ends of the sheet.

* * * * *